US006029372A

United States Patent [19]

Pan

[11] Patent Number: 6,029,372

[45] Date of Patent: Feb. 29, 2000

[54] THONG

[76] Inventor: Kung-Sheng Pan, 7F, No. 19-28, Chung Yung Rd., Nan Tun Area, Taichung, Taiwan

[21] Appl. No.: 09/115,666

[22] Filed: Jul. 14, 1998

[51] Int. Cl.[7] ..... A43B 3/12

[52] U.S. Cl. ..... 36/11.5; 36/3 R; 36/8.1; 36/43

[58] Field of Search ..... 36/11.5, 43, 44, 36/3 R, 3 B, 8.1

[56] References Cited

U.S. PATENT DOCUMENTS

| | | | |
|---|---|---|---|
| 381,259 | 4/1888 | Lee | 36/44 |
| 2,075,432 | 3/1937 | Dunbar | 36/3 B |
| 2,284,947 | 6/1942 | Clifford | 36/44 |
| 3,299,540 | 1/1967 | Scholl | 36/8.1 |
| 3,978,596 | 9/1976 | Brown et al. | 36/11.5 |
| 4,047,310 | 9/1977 | Sunoo | 36/11.5 |
| 4,272,898 | 6/1981 | Tansill | 36/44 |
| 4,348,820 | 9/1982 | D'Alessio | 36/11.5 |
| 4,419,836 | 12/1983 | Wong | 36/11.5 |
| 4,525,940 | 7/1985 | Mochizuki | 36/11.5 |
| 5,802,737 | 9/1998 | Beppu | 36/11.5 |
| 5,852,885 | 12/1998 | Ferniani | 36/11.5 |

*Primary Examiner*—Paul T. Sewell
*Assistant Examiner*—J. Mohandesi
*Attorney, Agent, or Firm*—Browdy and Neimark

[57] ABSTRACT

A thong is composed of a sole and a strap attached to the sole for securing a foot. The sole is provided in the upper surface thereof with a breathable body made of a plurality of elastic filaments which are intertwined to form a network body having a number of gaps for driving out foul air and foot perspiration.

2 Claims, 3 Drawing Sheets

THONG

FIELD OF THE INVENTION

The present invention relates generally to a footwear, and more particularly to a thong.

BACKGROUND OF THE INVENTION

The conventional thongs consist of an insole that is not permeable to air or water. As a result, the sole perspiration of a foot wearing the thong is prone to accumulate between the foot sole and the insole, thereby causing various skin disorders of the foot. In addition, the insole of the conventional thongs is too rigid to give a wearing comfort to the wearer. Moreover, the insole of the conventional thongs does not provide a sufficient friction between the foot sole and the insole.

SUMMARY OF THE INVENTION

The primary objective of the present invention is therefore to provide an improved thong free from the drawbacks of the conventional thongs described above.

In keeping with the principle of the present invention, the foregoing objective of the present invention is attained by a thong consisting of a sole, a strap fastened with an upper surface of the sole, and a breathable body which is made of a plurality of elastic filaments and is attached to the upper surface of the sole.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
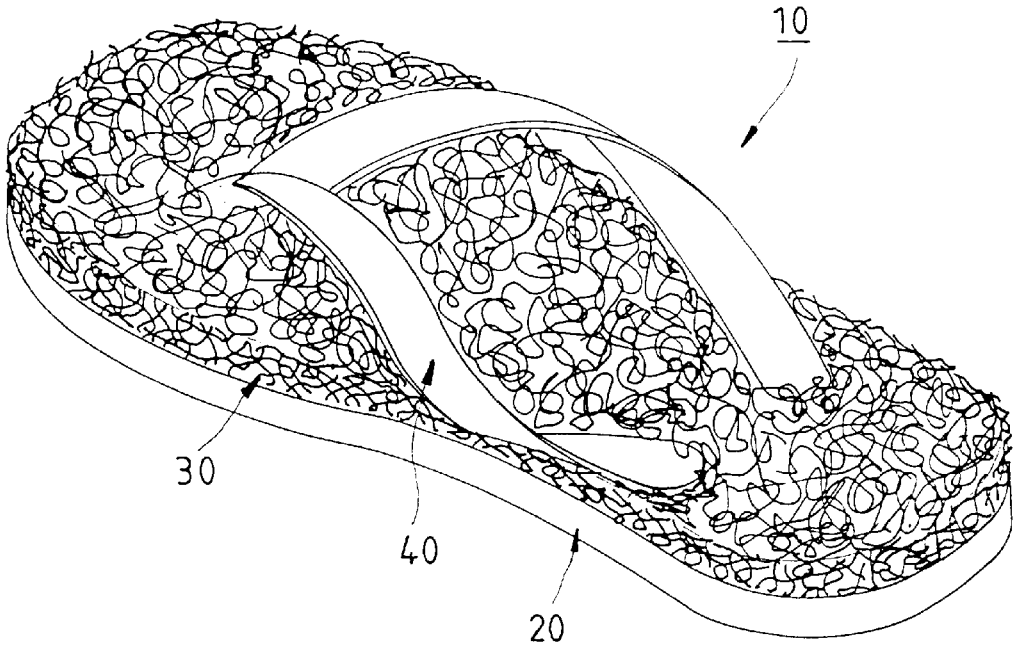
FIG. 1 shows a perspective view of a first preferred embodiment of the present invention.
Figure 3:
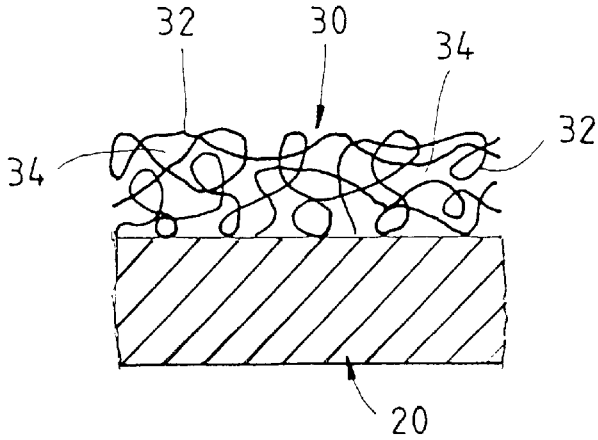
FIG. 3 shows a partial side view of the first preferred embodiment of the present invention.
Figure 2:
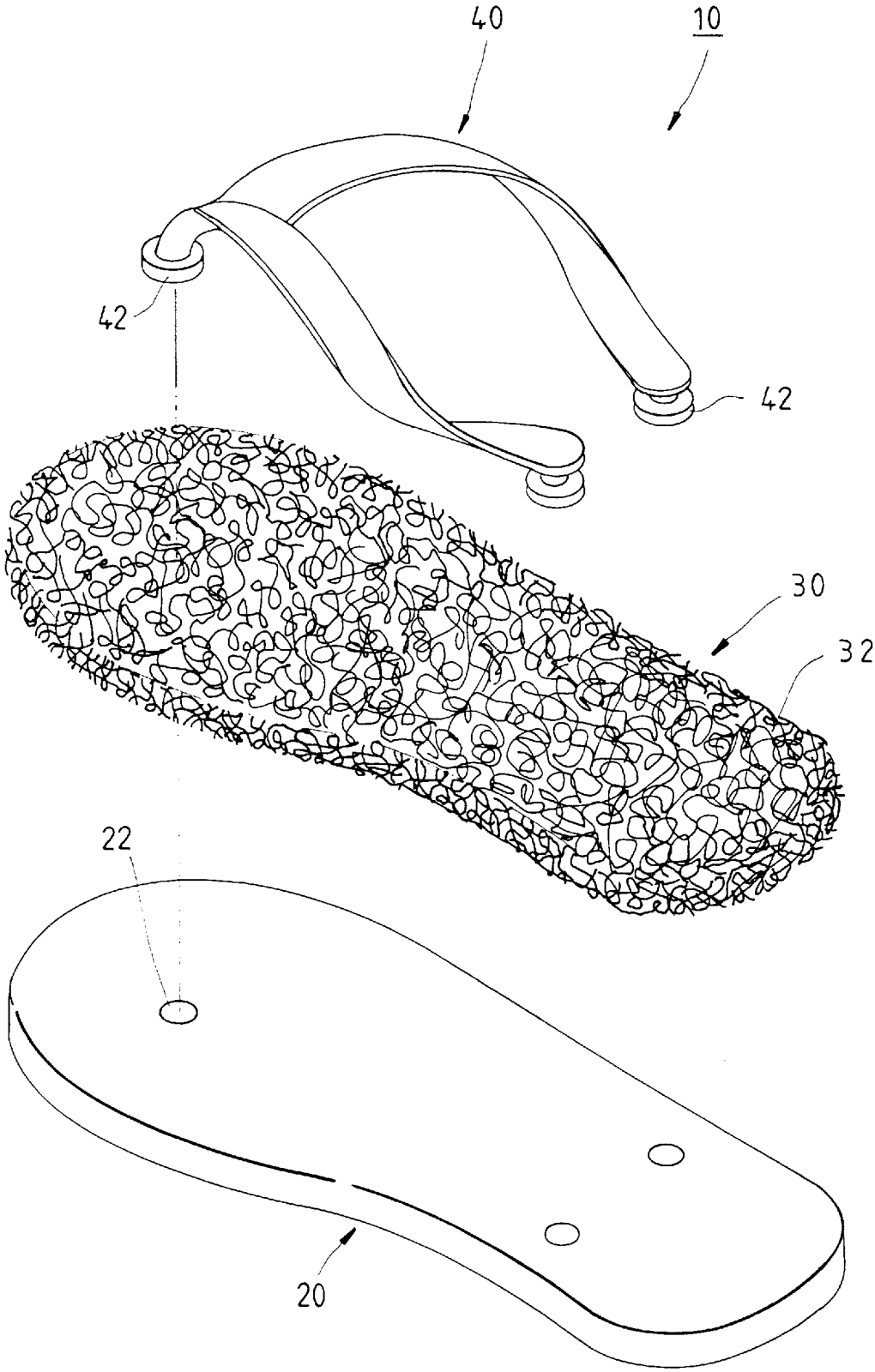
FIG. 2 shows an exploded view of the first preferred embodiment of the present invention.

As shown in FIGS. 1–3, a thong 10 of the first preferred embodiment of the present invention is composed of a sole 20, a breathable body 30 attached to an upper surface of the sole 20, and a strap 40 attached to the upper surface of the sole 20 for securing a foot.

The sole 20 is made of a plastic or leather material having an appropriate pliability.

The breathable body 30 is formed of a plurality of elastic filaments 32 of polyvinyl chloride (PVC). The filaments 32 are intertwined to form an intricate network body of an appropriate thickness and having a number of gaps 34, as shown in FIG. 3. The gaps 34 serve as a ventilation system for driving out the foul air as well as the foot perspiration.

The strap 40 is of a Y-shaped construction and is composed of three retaining portions 42, which are securely retained in three retaining holes 22 of the sole 20. Like the breathable body 30, the strap 40 is attached to the upper surface of the sole 20.

Figure 4:
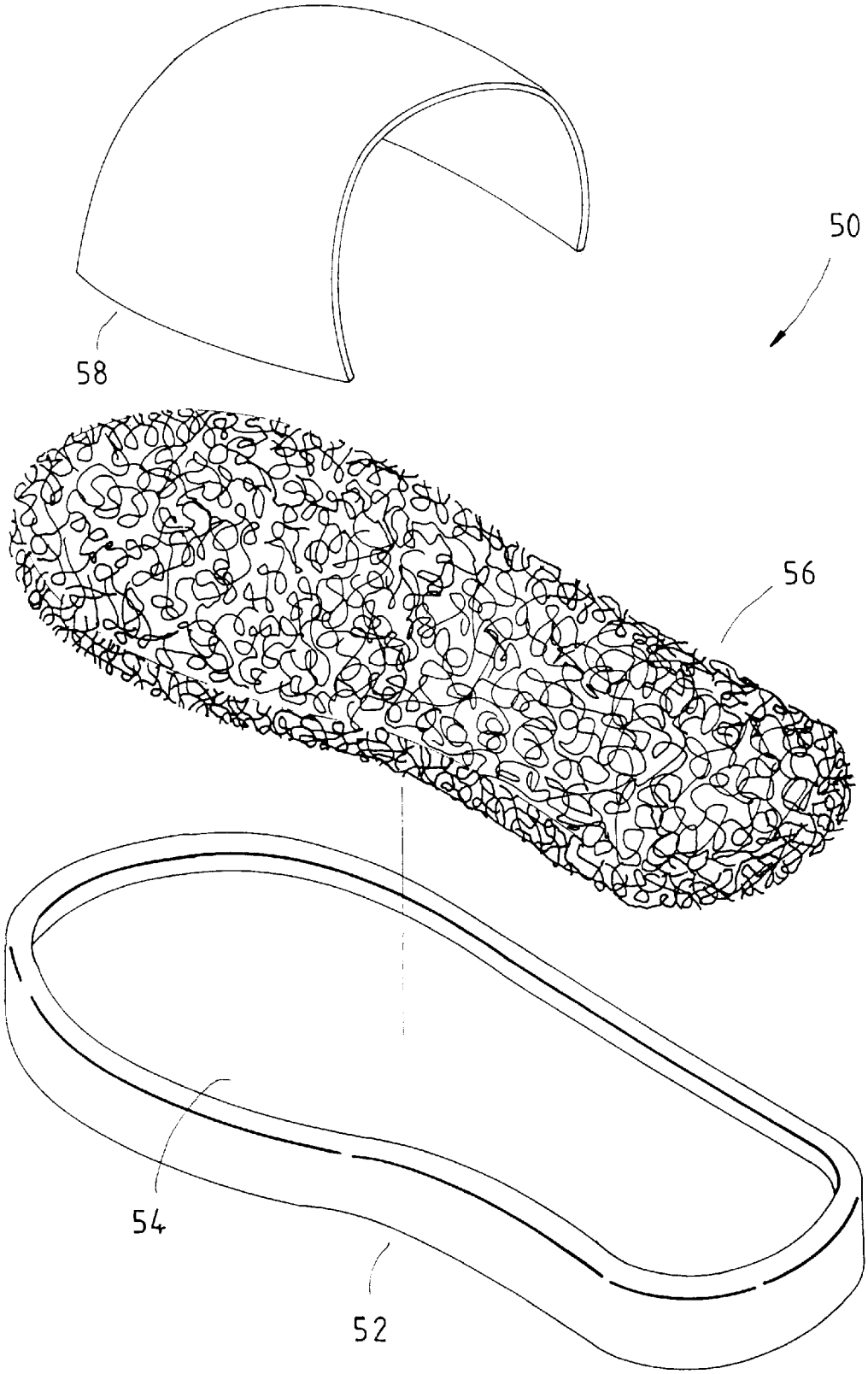
FIG. 4 shows an exploded view of a second preferred embodiment of the present invention.

As shown in FIG. 4, a thong 50 of the second preferred embodiment of the present invention is composed of a sole 52, a breathable body 56, and a strap 58. The sole 52 is provided in the upper surface thereof with a recessed portion 54 which is shaped and dimensioned to accommodate the breathable body 56. The strap 58 is of an archlike construction and is fastened at both ends thereof with the sole 55 for securing a foot. The breathable body 56 is similar in component and construction to the breathable body 30 of the first preferred embodiment of the present invention. The breathable bodies 30 and 56 are capable of driving out the foul air and the foot perspiration, providing a wearing comfort, a massaging effect of the foot sole, and a friction between the foot sole and the breathable body.

What is claimed is:

1. A thong comprising:

a sole;

a strap engaged to an upper surface of said sole for securing a foot;

said sole being provided on the upper surface thereof with a breathable body attached thereto;

said sole being provided in the upper surface thereof with a recess shaped and dimensioned to accommodate breathable body;

said strap is of an archlike construction; and wherein said breathable body is made of a plurality of elastic filaments of polyvinyl chloride (PVC), said elastic filaments being intertwined to form a network body having a thickness and a plurality of spaces to permit air and foot perspiration to be expelled from said breathable body when compressed by a user.

2. A thong comprising:

a sole;

a strap engaged to an upper surface of said sole for securing a foot;

said sole being provided on the upper surface thereof with a breathable body attached thereto;

said sole being provided in the upper surface thereof with a recess shaped and dimensioned to accommodate breathable body;

said strap is of a Y-shaped construction; and wherein said breathable body is made of a plurality of elastic filaments of polyvinyl chloride (PVC), said elastic filaments being intertwined to form a network body having a thickness and a plurality of spaces to permit air and foot perspiration to be expelled from said breathable body when compressed by a user.

* * * * *